United States Patent [19]

Geurts

[11] Patent Number: 4,776,814

[45] Date of Patent: Oct. 11, 1988

[54] ELECTRIC PLUG

[76] Inventor: Jan V. M. Geurts, Groenewoudseweg 1, Eindhoven, Netherlands

[21] Appl. No.: 139,089

[22] Filed: Dec. 23, 1987

Related U.S. Application Data

[63] Continuation of Ser. No. 836,046, Mar. 4, 1986, abandoned.

[30] Foreign Application Priority Data

Mar. 6, 1985 [NL] Netherlands ..... 8500623

[51] Int. Cl.[4] ..... H01R 19/06

[52] U.S. Cl. ..... 439/694; 439/475

[58] Field of Search ..... 339/210 M, 195 R, 195 M, 339/195 A, 62, 196 R, 196 M; 439/474, 475, 597–601, 692–697, 736, 606

[56] References Cited

U.S. PATENT DOCUMENTS

| | | | |
|---|---|---|---|
| 1,780,851 | 11/1930 | Strongson | 339/62 |
| 2,226,433 | 12/1940 | Herman | 339/62 |
| 2,543,951 | 3/1951 | Aime | 339/195 R |
| 2,723,381 | 11/1955 | Collins | 339/195 R |
| 2,894,242 | 7/1959 | Bickford et al. | 339/195 R |
| 3,742,432 | 6/1973 | Curtis et al. | 339/276 T |
| 4,405,194 | 9/1983 | van Lierop | 439/606 |

FOREIGN PATENT DOCUMENTS

| | | | |
|---|---|---|---|
| 1449215 | 12/1966 | France | 339/62 |
| 0248098 | 4/1947 | Switzerland | 339/195 R |
| 2050076 | 12/1980 | United Kingdom | 339/210 M |

*Primary Examiner*—Neil Abrams

*Attorney, Agent, or Firm*—Thomas A. Briody; Jack E. Haken; Leroy Eason

[57] ABSTRACT

An electrical plug comprising a base having connection pins secured therein, end portions of such connection pins projecting from the front of the base and opposite end portions thereof extending through the base and being respectively connected to respective connection terminals to which respective conductors of a connection cable are also connected. The material and shape of the base are such that it bends in response to a pulling force of a magnitude less than the tensile strength of the cable, exerted in a direction approximately transverse to the connection pins between the cable and the projecting end portions of the connection pins. Further, the connection pins are so secured in the base that the force required to extract any connection pin is greater than the tensile strength of the cable. Consequently, pulling of the cable can never result in a loose connection pin being left behind in a wall socket in which the plug has been inserted.

2 Claims, 2 Drawing Sheets

ELECTRIC PLUG

This is a continuation of application Ser. No. 836,046 filed Mar. 4, 1986, now abandoned.

BACKGROUND OF THE INVENTION

1. Field of the Invention

The invention relates to an electrical plug, comprising a base and connection pins which project from the front thereof and which are connected to conductors of a connection cable via connection points, the base being accomodated in a plastics plug body which leaves free the portions of the connection pins which project from the front of the base.

2. Description of the Prior Art

Such a plus is known from issued Netherlands Patent Application No. NL-A-80 06 481, corresponding to U.S. Pat. No. 4,405,194, issued Sept. 20, 1983, assigned to the present assignee, and which is incorporated herein by reference. The plug body is preferably shaped so that it can be easily held by hand for insertion into or withdrawal from a wall outlet. Some users, however, tend to remove the plug from the wall outlet by pulling the cable. It has been found that sometimes one of the connection pins is then pulled out of the base so that it is left behind in the wall outlet. This occurs notably when the pulling force is directed approximately perpendicularly to the longitudinal direction of the connection pins. The connection pin is then broken out of the base by a twisting movement. It will be evident that a connection pin left behind in the wall outlet is very dangerous to touch.

SUMMARY OF THE INVENTION

It is the object of the invention to provide a plug of the kind described in which it is impossible to break a connection pin out of the base by pulling the cable. To this end, the plug in accordance with the invention is characterized in that the magnitude of the pulling force required to be exerted in a direction approximately transverse to the longitudinal direction of the connection pins between the cable and the free end portions of the connection pins, in order to bend the base so as to change the position of such free end portions with respect to the base, is less than the tensile strength of the cable. Further, the force required to extract a connection pin from the base is greater than the tensile strength of the cable.

It is thus achieved that when the cable is pulled, one or more of the connection pins merely assume a different position with respect to the base and the plug body, without the connection pins being broken out of the base. Consequently, dangerous situations can no longer arise and the plug generally becomes unsuitable for use after such deformation.

Should the connection pin remain jammed in the wall outlet after the described deformation, further pulling could cause a rupture of the cable. Should such a rupture occur outside the plug body, the bare end of the piece of cable still attached to the plug could also be dangerous. Because the weakest portion of the cable (the portion wherefrom the outer jacket has been removed) is situated within the plug body, the risk of a rupture occuring outside the plug body is extremely low. In order to reduce this risk even further, a preferred embodiment of the plug in accordance with the invention is characterized in that the strength of the attachment between the conductors of the connection cable and the connection terminals is less than the tensile strength of the cable. Thus, the cable will be detached from the connection terminals before the cable itself is ruptured, so that no piece of cable can remain attached to one of the connection terminals of the plug.

BRIEF DESCRIPTION OF THE DRAWINGS

The invention will be described in detail hereinafter with reference to the drawings. Therein.

DESCRIPTION OF THE PREFERRED EMBODIMENTS

Figure 1:
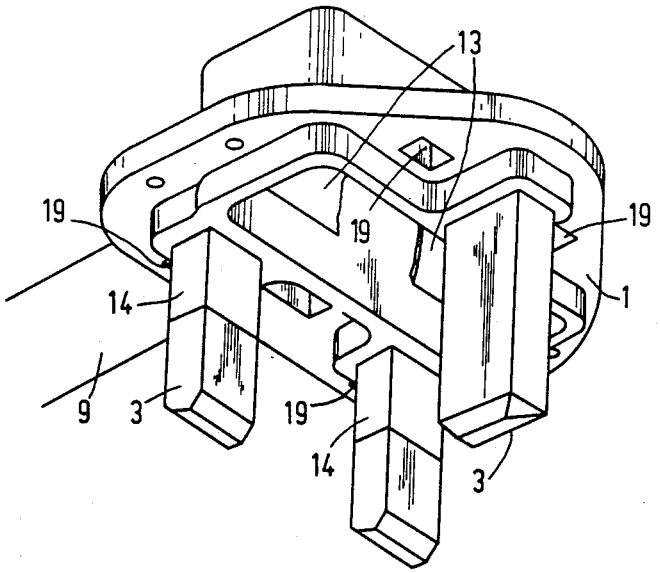
FIG. 1 is a perspective view of a base for an embodiment of a plug in accordance with the invention.
Figure 2:
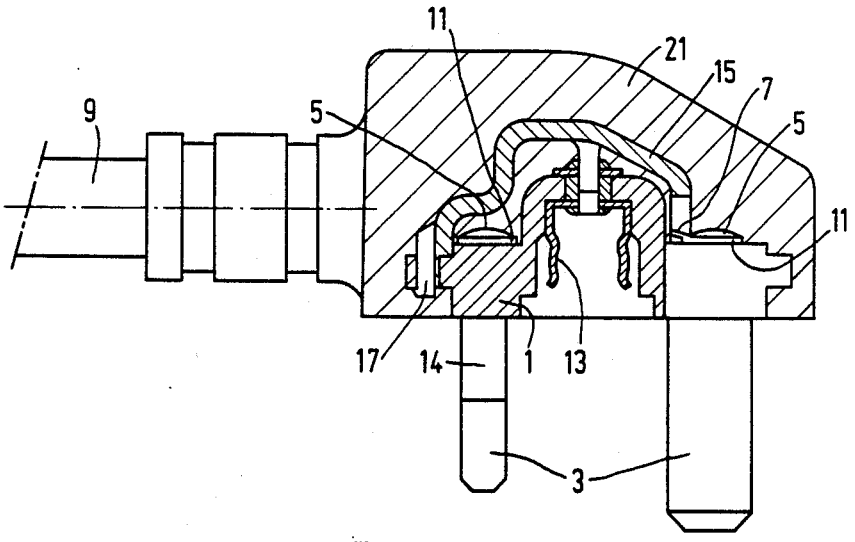
FIG. 2 is a longitudinal sectional view of an embodiment of a complete plug.

FIG. 1 shows a base 1 of an insulating material; from the front (the lower side in FIG. 1) thereof the end portions of three connection pins 3 project, the opposite end portions thereof being connected to connection terminals 5 at the rear of the base (see also FIG. 2). Each terminal 5 is further connected to a conductor 7 of a connection cable 9 when the plug is assembled. For this purpose the end of each conductor 7 is provided with an eyelet 11 which is riveted to the associated terminal 5. Only one of the three conductors 7 is visible in FIG. 2. One of the three connection pins 3 is connected to the associated conductor by means of two clamping contacts 13. Further details of terminal 5 are described in the above cited U.S. Pat. No. 4,405,194, and as explained therein the connection of a conductor to the clamping contacts 13 may comprise a fuse (not shown). The extreme right connection pin 3 of the base shown is constructed as the ground contact; the other two connection pins 3 are respectively intended to contact the zero reference and high voltage connections of a wall outlet (not shown). For example, the extreme left connection pin 3 in FIG. 1 is thus connected to a conductor of the connection cable 9 via the clamping contacts 13. The extreme right connection pin (ground contact) is longer than the other two pins. The free end portions of the two connection pins 3 at the left which project from the base 1 are enclosed over a part of their length by a jacket 14 which is made of the same material as that used for the base. This type of plug is suitable for wall outlets which are, for example customarily used in Great Britain.

The plug also comprises an insulating cap 15 which is secured to the rear of the base by means of integral resilient hooks 17 which project through openings 19 in the base 1. As appears from FIG. 2, the insulating cap 15 covers the terminals 5 of the two connection pins 3 which do not serve as the ground contact. Should one of the wires of a multi-wire conductor 7 fail to be attached to the connection terminal to which the conductor is connected, it will remain within the space bounded by the insulating cap 15 and the base 1 after the mounting of the insulating cap 15.

After the mounting of the insulating cap 15, the rear of the base 1 and the entire insulating cap and its contents are provided with a plastics plug body 21 by injection moulding. The plug body encloses the base 1 on all sides, except the front wherefrom the connection pins 3 project.

The connection pins 3 are firmly secured in the base 1 so that the force required for pulling a connection pin out of the base (referred to as break-out strength) amounts to, for example, 3000 Newtons (N) for the right-hand connection pin and to 2000 N for each of the other two pins. In order to achieve such a high break-out strength use can be made of a known construction, for example a suitable profile, or a suitable surface treatment of the portion of the connection pin which is surrounded by the material of the base.

The tensile strength of the cable 9 is less than the break-out strength of the connection pins, for example, 600 N. The tensile strength of the cable is to be understood to mean herein the tensile strength of the weakest portion of the cable. This is the portion which is situated inside the plug body 21 and wherefrom the outer jacket has been removed. As a result of the presence of the outer jacket, the portion of the cable which is situated outside the plug body 21 has a higher tensile strength.

The material and the shape of the base 1 are chosen so that the base can be bent by exerting a pulling force between the cable 9 and one of the connection pins 3, which pulling force is directed approximately transverse to the longitudinal direction of the connection pins and is less than the break-out strenght of the connection pins as well as the tensile strength of the cable, so less than 600 N in the described example. A suitable material for the base is, for example, polyamide. It is also possible to provide that an intermediate portion of each connection pin 3 is weakened so that it has reduced lateral bending strength so that the connection pin itself will be bent in that weakened area under the influence of the described pulling force. Such a weakened portion should preferably be formed in the portion of the connection pin which is situated inside the plug body 21 or at the transition between this portion and the free end portion.

Figure 3A:
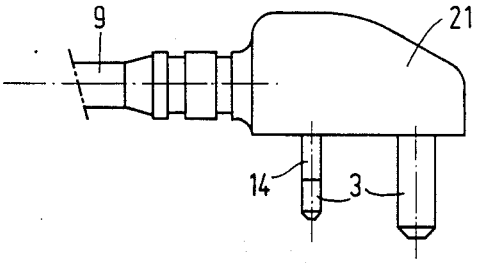
FIGS. 3A to D are side elevations of a plug during a tensile strength test.
Figure 3B:
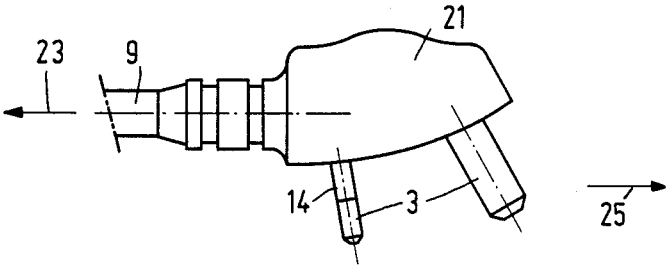
Figure 3C:
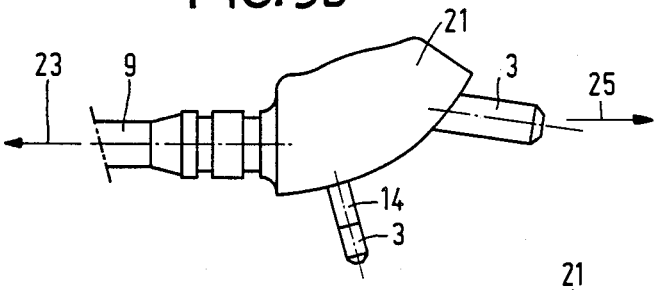
Figure 3D:
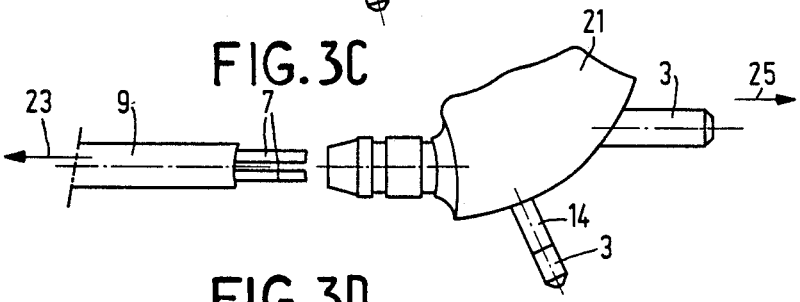

FIG. 3A is a side elevation of a plug having the described construction. When this plug is inserted in a wall socket, the free ends of the connection pins 3 are situated in contact sleeves (not shown) within the socket. When the cable 9 is pulled in a direction perpendicular to the longitudinal direction of the connection pins 3 as indicated in FIG. 3B by an arrow 23, the contact sleeves will exert an equal but oppositely directed force 25 on the connection pins. Because the connection pins 3 at the left are comparatively short, it is not unlikely that these pins will be completely or almost completely pulled out of the wall socket when the cable is pulled. The longer connection pin 3 at the right, however, will remain in the contact sleeve of the wall outlet in many cases, so that the force 25 will be exerted mainly on this connection pin. Because of the described ratio of the break-out strength of the connection pins 3, the tensile strength of the cable 9 and the force required for bending the base so as to change its position relative to the free end portions of the connection pins 3, the free end of the right hand connection pin 3 will now be displaced to the right as shown in the FIGS. 3B and 3C, due to deformation of the comparatively elastic plug body 21. FIG. 3D illustrates the situation in which such deformation has resulted in the free end of the right-hand connection pin 3 being displaced through an angle of approximately 90° relative to the base so that it extends in the same direction as the cable 9. Generally, the right-hand connection pin 3 will be pulled out of the wall socket at this instant, after which the connection pins will remain approximately in the position shown, so that the plug can no longer be inserted into a wall outlet and becomes unsuitable for further use. Evidently, this is desirable because after the described treatment the plug must be considered to be unsafe. However, should the right-hand connection pin 3 remain in the wall outlet even in the situation shown in FIG. 3D, the tensile strength of the cable 9 will be exceeded when pulling is continued. Because, as has already been described, the weakest point of the cable is situated in the bare portion thereof inside the plug body 21, the cable will be ruptured inside the plug body so that no potentially dangerous piece of cable which is still attached to the connection pins will project from the plug body. Even more certainty that any cable rupture will always occur inside the plug body 21 can be obtained by affixing the conductor 7 of the cable to the connection terminals 5 in such a manner that the strength of the attachment between these conductors and the connection terminals 5 is less than the tensile strength of the cable.

A type of plug comprising three connection pins as commonly used in Great Britain has been described as an example of a plug in accordance with the invention. It will be apparent that the described steps can also be taken for other types of plugs, possibly comprising a different number of connection pins, for example the types commonly used on the European continent.

What is claimed is:

1. An improved electrical plug comprising: a base; a plurality of parallel connection pins having front end portions which project transversely from a front surface of the base and rear end portions which are secured in the base, the projecting front end portions of the connection pins being positioned relative to the base in a predetermined pattern enabling said base to be mated with a socket having contact sleeves therein for receiving the front end portions of said connection pins; and a plurality of connection terminals respectively secured to said rear end portions of the respective connection pins, such connection terminals being adapted to be respectively affixed to respective conductors of a connection cable to be connected by said plug to said socket, such cable extending from said connection terminals in a direction approximately transverse to said connection pins, said improvement being characterized in that:

said rear end portions of said connection pins are so secured in said base that the tensile force required to extract any connection pin therefrom exceeds the tensile strength of said cable;

said base is of a material and shape such that when said plug is mated with said socket and a pulling force exceeding a predetermined magnitude is exerted on said cable in a direction approximately transverse to said connection pins, said base will bend so as to at least partially withdraw at least one of said connection pins from said socket and will permanently remain so bent, thereby permanently altering the positions of said connecting pins relative to said base so that they are no longer in said predetermined pattern enabling said plug to mate with said socket; and said predetermined magnitude of said pulling force on said cable for so bending said base is less than the tensile strength of said cable.

2. An improved electrical plug in accordance with claim 1, wherein the base material is a polyamide.

* * * * *